United States Patent [19]

Specktor

[11] 4,336,705

[45] * Jun. 29, 1982

[54] APPARATUS FOR REPAIRING AND STRAIGHTENING

[76] Inventor: Gerald A. Specktor, 409 Cleveland Ave. South, St. Paul, Minn. 55105

[ * ] Notice: The portion of the term of this patent subsequent to May 1, 1996, has been disclaimed.

[21] Appl. No.: 18,959

[22] Filed: Mar. 9, 1979

Related U.S. Application Data

[63] Continuation of Ser. No. 496,848, Aug. 12, 1974, Pat. No. 4,151,737.

[51] Int. Cl.[3] ..... B21D 1/12

[52] U.S. Cl. ..... 72/457; 72/705

[58] Field of Search ..... 72/705, 457

[56] References Cited

U.S. PATENT DOCUMENTS

| | | | |
|---|---|---|---|
| 2,013,785 | 9/1935 | Merrill | 72/705 X |
| 2,442,425 | 6/1948 | Merrill et al. | 72/705 X |
| 2,445,397 | 7/1948 | Horton | 72/705 X |
| 2,692,002 | 10/1954 | Merrill et al. | 72/705 X |
| 2,717,020 | 9/1955 | Dobias | 72/705 X |
| 3,214,959 | 11/1965 | Bowden | 72/705 X |
| 3,257,838 | 6/1966 | Spears | 72/705 X |
| 3,269,169 | 8/1966 | Latuff et al. | 72/705 X |
| 3,377,834 | 4/1968 | Latuff et al. | 72/705 X |
| 3,626,747 | 12/1971 | Rouis | 72/705 X |
| 3,776,022 | 12/1973 | Lionello | 72/705 X |
| 3,777,541 | 12/1973 | Whitney | 72/705 X |
| 3,798,956 | 3/1974 | Kopczynski | 72/422 |
| 3,835,693 | 9/1974 | Majersky | 72/705 X |
| 3,888,100 | 6/1975 | Chisum | 72/705 X |

FOREIGN PATENT DOCUMENTS 1011759 12/1965 United Kingdom ..... 72/705

OTHER PUBLICATIONS

The American Heritage Dictionary of the English Language; Pub. by Houghton Mifflin Co.; 1976.

*Primary Examiner*—Lowell A. Larson
*Attorney, Agent, or Firm*—Wicks & Nemer

[57] ABSTRACT

Apparatus for repairing and straightening is disclosed in its preferred form for use in repairing and straightening the body and frame of a vehicle. The preferred apparatus includes a tread member including left and right track members for supporting a vehicle thereon, a tram member movable along and between the right and left track members and including two elongatable pull towers pivotally mounted thereto, and an additional elongatable pull tower mounted adjacent an end of the apparatus. A flexible connector, preferably a chain, is arranged for connection between the pull towers and the vehicle. The track members further include regularly shaped apertures which vertically pass therethrough. Locking pins are also provided which extend through an aperture of the track members and abut with a portion of the pull towers to lock the pull towers at any desired angle to the tread member. Bolsters are further provided which extend through the regular apertures of the track member and abut with a portion of the vehicle frame for anchoring the vehicle to the apparatus to prevent the vehicle from moving when it is subjected to the counter forces during the repair and straightening operation.

25 Claims, 15 Drawing Figures

APPARATUS FOR REPAIRING AND STRAIGHTENING

CROSS REFERENCE

This is a continuation of application Ser. No. 496,848 filed Aug. 12, 1974, by the same inventor, now U.S. Pat. No. 4,151,737.

BACKGROUND

This invention relates generally to a repair and straightening apparatus and more particularly, in the preferred embodiment, to apparatus for repairing and straightening vehicle bodies and frames.

In the field of vehicle frame and body repairing and straightening, various types of apparatus are currently available. Several types of apparatus currently known to be available present serious limitations and deficiencies regarding the ability of repair personnel to work on both the front and rear ends of a vehicle. Presently, whenever it is necessary to work on both the front and rear ends of a vehicle, it is necessary for the vehicle to be turned in these apparatus to expose the damaged portions of the vehicle to the repair members of the apparatus. It is thus immediately obvious that such a cycle of repair-turn-around-repair is time consuming and thus of great expense to both the repair operator and the owner of the vehicle.

Further, types of apparatus presently known to be available which do repair a vehicle around its entire 360 degree periphery are complicated and expensive. For example, one such apparatus requires a working pit and the use of complicated structure for the positioning of the pulling members.

Therefore, there is a definite need in the art for a vehicle body and frame straightening and repairing device which allows several repair operations to be performed on a vehicle, including the repair of both the front and rear portions, without the necessity of removing the vehicle from the device, turning it around, and remounting it on the device.

There is also a definite need in the art for a vehicle body and frame straightening and repairing device which is flexible such that the repair force can be applied in a direction parallel to the direction of the force that caused the damage. Further the apparatus should be of a simple design, efficient, and easy to operate to reduce the amount of time and labor required for the repair of damages and to maximize the equipment and materials used.

SUMMARY

The present invention solves these and other problems in vehicle repair and straightening by providing, in the preferred embodiment, an apparatus for repairing and straigtening the body and frame of a wheeled vehicle including a tread member, for the support of the vehicle thereon, having regularly shaped apertures therethrough. The apparatus further has the ability to apply a pulling force at any position 360 degrees around the vehicle.

In the preferred embodiment, a tram, movable along and between the right and left tracks of the tread member and including pulling members pivotally mounted thereto, is used to apply the pulling force to any position 360 degrees around the vehicle.

Pull tower locking pins are further provided for use in locking the pull towers at any angle with respect to the tread member. The locking pins include a body portion which substantially fills an aperture of the tread member and a portion which abuts with a portion of the pull towers.

Vehicle securing members in the form of bolsters are further provided. The bolsters include a body portion which substantially fills an aperture of the tread member and an abutting portion which interacts with the vehicle frame. A locking ring is used to hold the bolster within the aperture of the tread member adjacent the vehicle.

Therefore, it is a primary object of this invention to provide a novel repair and straightening apparatus.

It is also an object of this invention to provide a novel repair and straightening apparatus for vehicles.

It is also an object of this invention to provide a novel repair and straightening apparatus for repairing a vehicle around its entire 360 degree periphery.

It is also an object of this invention to provide a novel repair and straightening apparatus of simple design which is flexible to allow the repair force to be applied at any desired angle corresponding to the direction of the damaging force.

It is also an object of this invention to provide a novel repair and straightening apparatus which maximizes the equipment and materials used.

It is also an object of this invention to provide a novel apparatus which repairs and straightens frames and bodies of vehicles in an efficient manner.

It is also an object of this invention to provide a novel repair and straightening apparatus with means for allowing easy and quick locking of the pull towers at a desired angle about the item to be repaired.

It is also an object of this invention to provide novel repair and straightening apparatus with means for allowing the easy and rapid securing of a vehicle onto the apparatus.

It is yet another object of this invention to provide a novel repair and straightening apparatus with means for maximizing the pulling force applied to a damaged vehicle.

These and further objects and avantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where:

FIG. 3 is a top view of the apparatus of FIG. 1.

Figures 1, 4, 7:
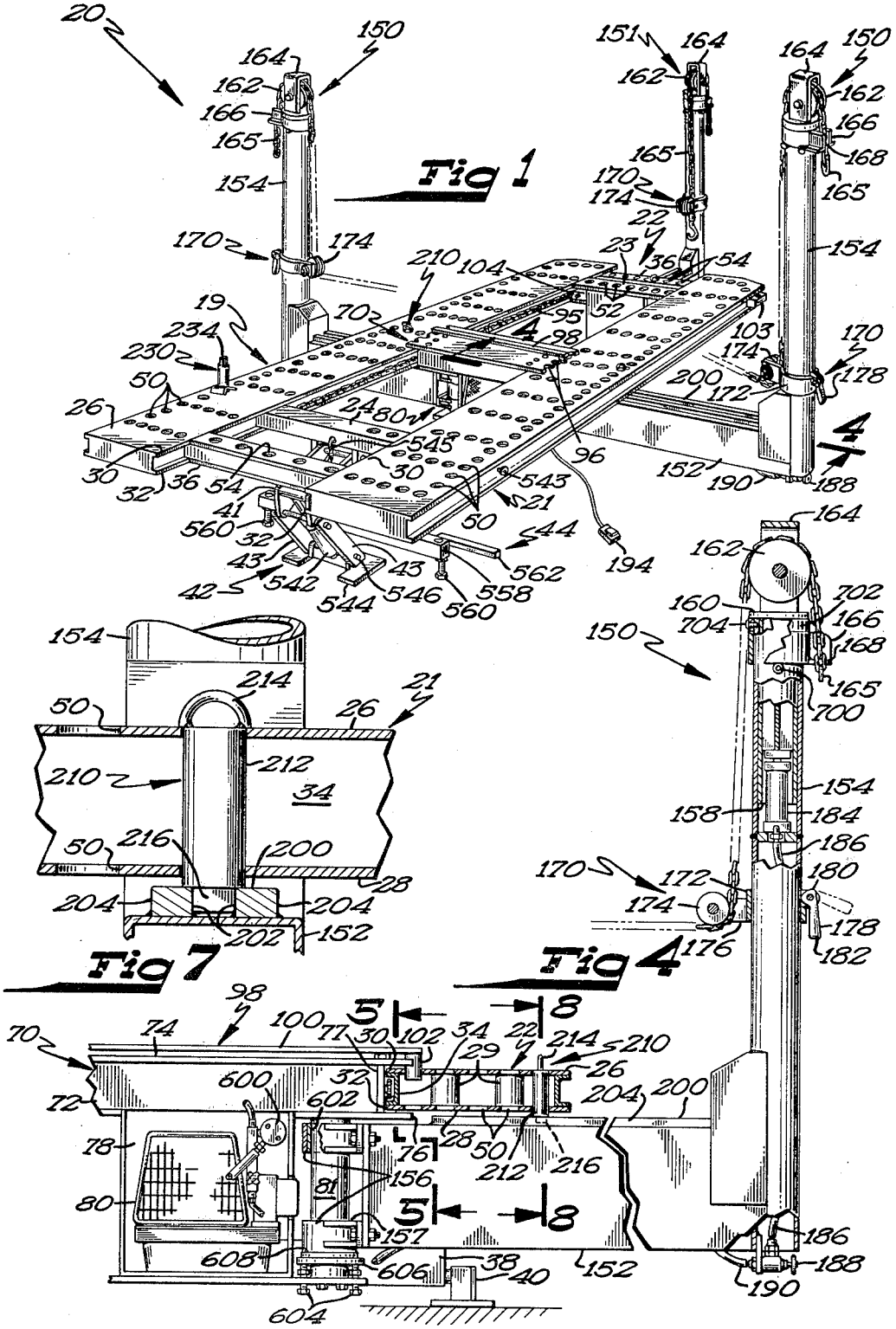
FIG. 1 is a perspective view of an apparatus for repairing and straightening the body and frame of a vehicle according to the teachings of the present invention.
FIG. 4 is a partial sectional view taken along section line 4—4 in FIG. 1.
FIG. 7 is a partial sectional view taken along section line 7—7 in FIG. 3.
Figures 2, 5, 6, 8, 9:
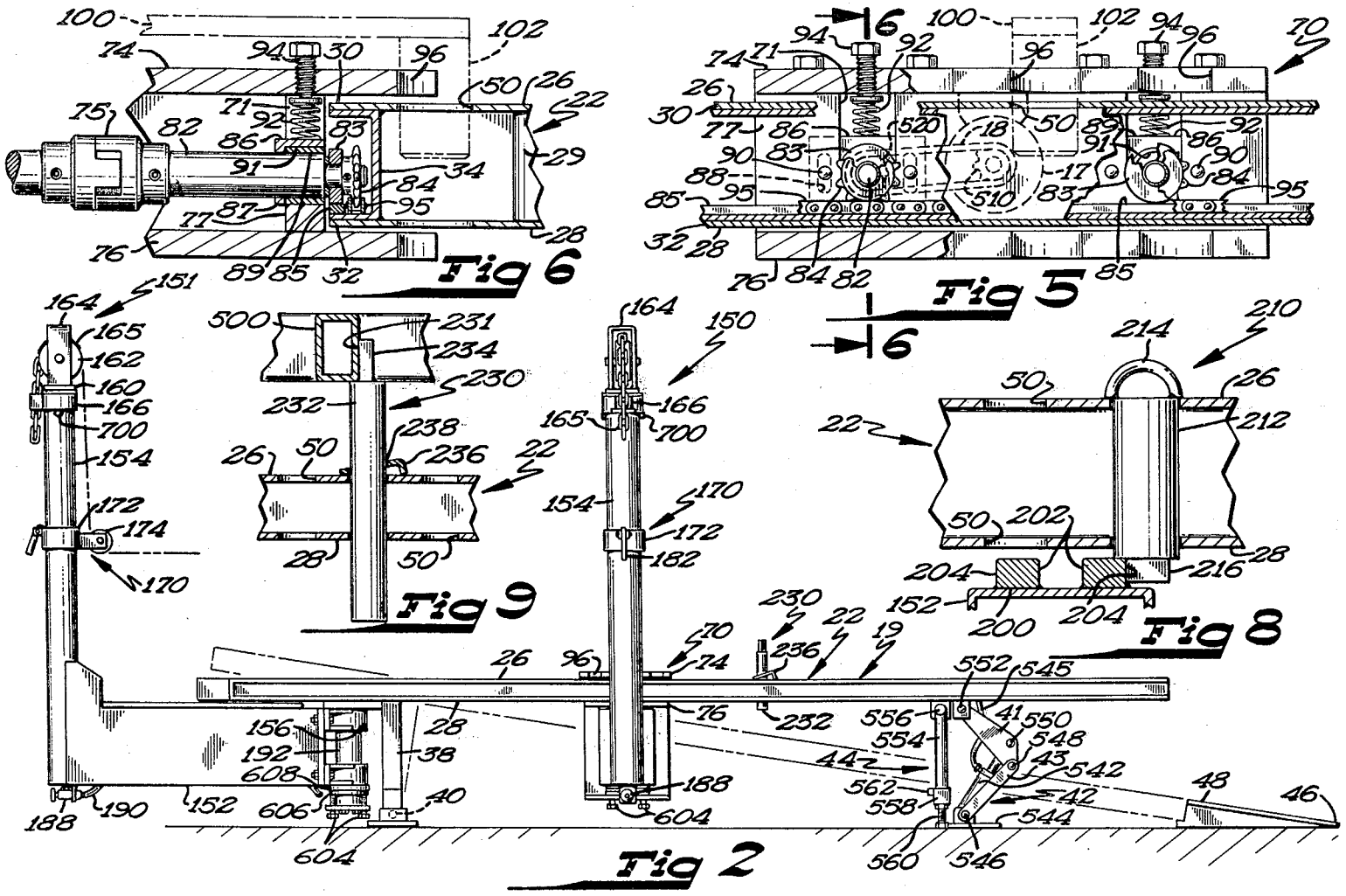
FIG. 2 is a side elevation view of the apparatus of FIG. 1.
FIG. 5 is a sectional view taken along section line 5—5 in FIG. 4.
FIG. 6 is a partial sectional view taken along section line 6—6 in FIG. 5.
FIG. 8 is a partial sectional view taken along section line 8—8 in FIG. 4.
FIG. 9 is a partial sectional view taken along section line 9—9 in FIG. 3.
Figures 9, 10:
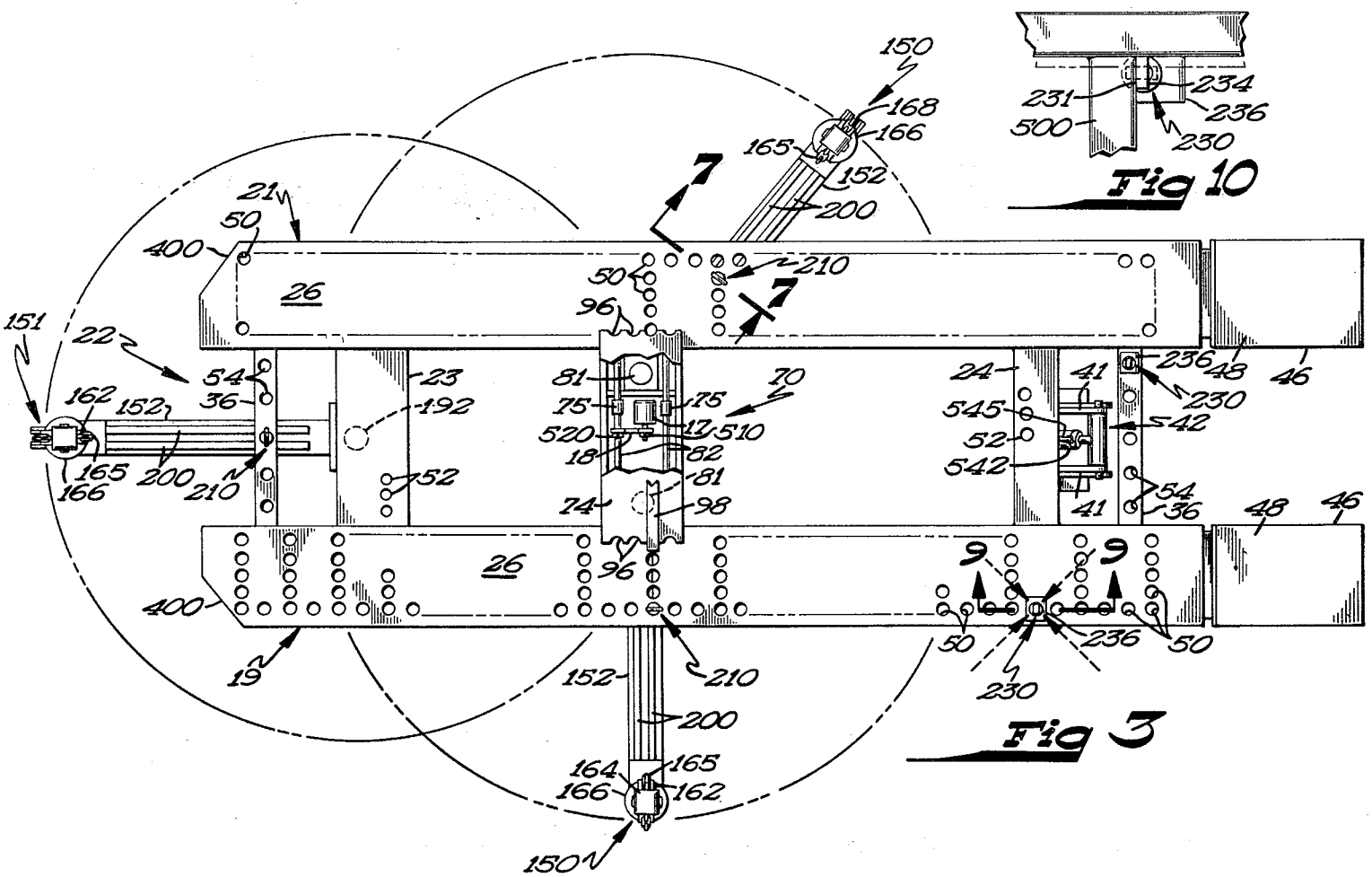
FIG. 10 is a top view of the sectional view shown in FIG. 9.
Figure 11:
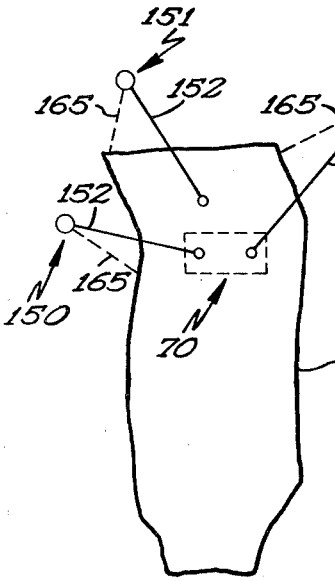
FIGS. 11–15 show diagrammatic views of example operations of the apparatus of FIG. 1.
Figure 12:
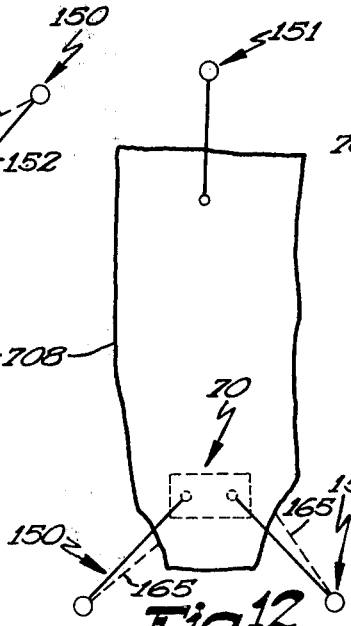
Figure 13:
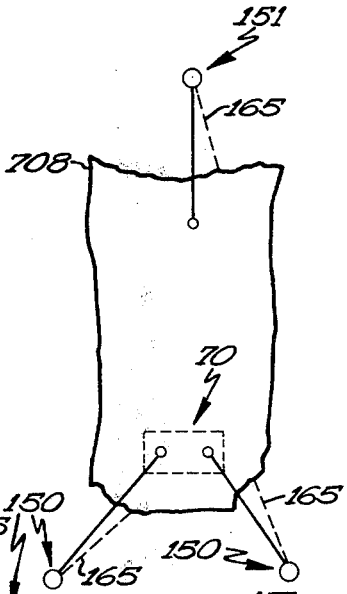
Figure 14:
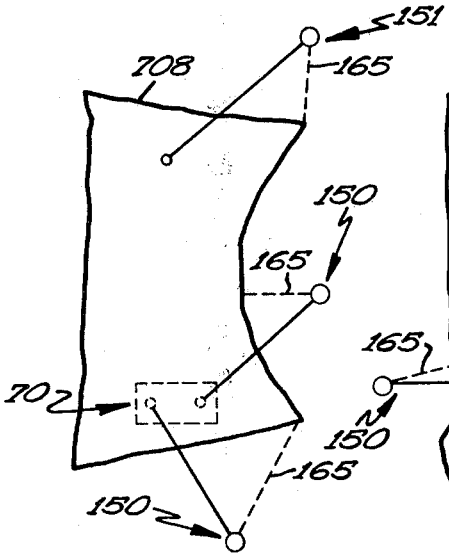
Figure 15:
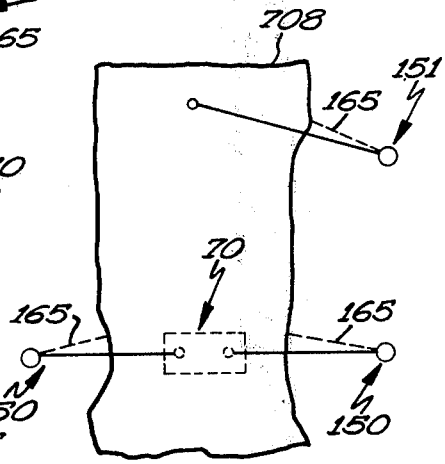

Where used in the various figures of the drawings, the same numerals designate the same or similar parts. Furthermore, when the terms "right", "left", "front", "back", "vertical", "horizontal", "right end", "left end", "inside", "rear", "bottommost", and similar terms are used herein, it should be understood that these terms have reference only to the structure shown in the drawings as it would appear to a person viewing the drawings and are utilized only to facilitate describing the invention.

DESCRIPTION

The remaining disclosure of the present invention, including preferred embodiments, is incorporated herein by reference to application Ser. No. 496,848 filed Aug. 12, 1974, by Gerald A. Specktor entitled "Apparatus For Repairing And Straightening", now U.S. Pat. No. 4,151,737, the parent application of the present application.

What is claimed is:

1. Apparatus for repairing and straightening the body and frame of a wheeled vehicle comprising, in combination: a tread member having a first end and a second end and having a top surface and a bottom surface and including a right track member and a left track member, each of the right and left track members having a top surface formed thereon to allow support of the vehicle thereon; means for allowing placement of a vehicle upon the tread member; at least one means for applying a force to the vehicle; a tram body; means for pivotally interconnecting the force applying means to the tram body to allow positioning the force applying means on the outside of the tread member; and means for movably mounting the tram body having the force applying means pivotally interconnected thereto in the space which separates the right and left track members including means for moving the tram body along the right and left track members to thereby allow the tram body to be positioned at substantially any position between the first end and the second end of the tread member and to allow the force applying means to be positioned at any desired angle around the tread member such that the reparing and straightening force can be applied at any angle around the entire 360 degree periphery of the vehicle.

2. The apparatus of claim 1 wherein the apparatus comprises: a first force applying means and a second force applying means and wherein the first force applying means is pivotally interconnected to the tram body adjacent to the right track member and the second force applying means is pivotally interconnected to the tram body adjacent to the left track member such that the first and second force applying means are located on opposite sides of the apparatus for repairing and straightening.

3. The apparatus of claim 2 wherein the apparatus further comprises: a third force applying means; and means for pivotally interconnecting the third force applying means about the first end and front sides of the tread members of the apparatus for repairing and straightening.

4. Apparatus for repairing and straigtening the body and frame of a wheeled vehicle comprising, in combination: a tread member having a first end and a second end and having a top surface and a bottom surface and including a right track member and a left track member, each of the right and left track members having a top surface formed thereon to allow support of the vehicle thereon; means for allowing placement of a vehicle upon the tread member; at least one means for applying a force to the vehicle; a tram body; means for pivotally interconnecting the force applying means to the tram body to allow positioning the force applying means on the outside of the tread member; and means for movably mounting the tram body having the force applying means pivotally interconnected thereto between the right and left track members including means for moving the tram body along the right and left track members to thereby allow the tram body to be positioned at substantially any position between the first end and the second end of the tread member and to allow the force applying means to be positioned at any desired angle around the tread member such that the repairing and straightening force can be applied at any angle around the entire 360 degree periphery of the vehicle, wherein the movably mounting means comprises, in combination: at least one rotatable shaft carried by the tram body having a first end which engages a portion of the right track member and a second end which engages a portion of the left track member; and wherein the moving means comprises, in combination: means for rotating the shaft and means operatively connected to the shaft for converting the rotation of the shaft to cuase movement of the tram body along the right and left track members.

5. The apparatus of claim 2 wherein the converting means comprises, in combination: a first stationary, elongated gear member located on the right track member; a second stationary, elongated gear member located on the left track member parallel to the first gear member; and wherein the tram body further includes: a first sprocket located on the first end of the shaft and engaging the first gear member; and a second sprocket located on the second end of the shaft and engaging the second gear member to form a rack and pinion gear arrangement such that as the rotatable shaft is rotated, the first and second sprockets mesh with the first and second stationary gear members thereby moving the tram along and between the track members.

6. The apparatus of claim 2 wherein the force applying means includes a hydraulic cylinder; wherein the apparatus further comprises a hydraulic unit for supplying hydraulic fluid to the hydraulic cylinder of the force applying means; and wherein the means for rotating the shaft and the hydraulic unit are carried by the tram body.

7. The apparatus of claim 2 wherein the converting means comprises, in combination: at least one stationary, elongated gear member attached to the apparatus for repairing and straightening, and wherein the shaft includes at least one sprocket which meshes with the stationary, elongated gear member.

8. The apparatus of claim 3 or 5 wherein the stationary, elongated gear member comprises chain links fastened to the apparatus for repairing and straightening.

9. The apparatus of claim 5 wherein the apparatus further comprises, in combination: means for reducing the amount of weight carried by the sprocket.

10. The apparatus of claim 6 wherein the reducing means comprises, in combination: a roller mounted on the shaft adjacent to the sprocket.

11. The apparatus of claim 7 wherein the apparatus further comprises, in combination: a rail portion formed adjacent to the stationary gear member upon which the roller rides.

12. Apparatus for repairing and straightening the body and frame of a wheeled vehicle comprising, in combination: a tread member arranged for allowing support of the vehicle thereon, with the tread member having a first end and a second end and having a right track member and a left track member spaced from the right track member, with the right and left track members having a top surface and a bottom surface and having a first flange; a body member; at least one means for applying a force to the vehicle; means for interconnecting the force applying means to the body member; means for movably mounting the body member to the first flanges of the right and left track members in the manner to allow the body member to be positioned at substantially any position between the first end and the second end of the tread member, with the body member arranged to accept counterforce from repairing and straightening the body and frame of the vehicle; and means for receiving at least upward and downward counterforces exerted on the body member and for subjecting the movably mounting means and the first flanges of the right and left track members only to the initial force under load condition, wherein the first flanges of the right and left track members are formed on the inside of the right and left track members, the body member is located between the right and left track members, and the movably mounting means movably mounts the body member between the right and left track members.

13. The apparatus of claim 12 wherein the first flange is formed on the track bottom surface and wherein the right and left track members further includes a second inside flange formed on the track top surface such that the first and second flanges form a C-shape track on the inside surface of each of the right and left track members, and wherein the movably mounting means comprises, in combination: at least one shaft carried by the body member and having a first end which engages the first flange of the right track member and a second end which engages the first flange of the left track member.

14. The apparatus of claim 13 wherein the means for receiving the counterforce includes means for resiliently mounting the shaft in the body member such that, under load condition, the shaft deflects due to the resiliently mounting means.

15. The apparatus of claim 12 wherein the movably mounting means includes means for moving the body member along and between the right and left track members.

16. The apparatus of claim 15 wherein the movably mounting means comprises, in combination: at least one shaft carried by the body member and having a first end which engages the first flange of the right track member and a second end which engages the first flange of the left track member.

17. The apparatus of claim 16 wherein the moving means comprises, in combination: means for rotating the shaft; and means operatively connected to the shaft for converting the rotation of the shaft to cause movement of the body member along and between the right and left track members.

18. The apparatus of claim 17 wherein the converting means comprises, in combination: a first stationary, elongated gear member located on the first flange on the right track member; a second stationary, elongated gear member located on the first flange of the left track member parallel to the first gear member; and wherein the body member further includes: a first sprocket located on the first end of the shaft and engaging the first gear member; and a second sprocket located on the second end of the shaft and engaging the second gear member to form a rack and pinion gear arrangement such that as the rotable shaft is rotated, the first and second sprockets mesh with the first and second stationary gear members thereby moving the tram along and between the track members.

19. The apparatus of claim 18 wherein the stationary, elongated gear members comprise chain links fastened to the flanges of the right and left track members.

20. Apparatus for repairing and straightening the body and frame of a wheeled vehicle comprising, in combination: a tread member arranged for allowing support of the vehicle thereon, with the tread member having a first end and a second end and having a right track member and a left track member spaced from the right track member, with the right and left track members having a top surface and a bottom surface and having a first flange; a body member; at least one means for applying a force to the vehicle; means for interconnecting the force applying means to the body member; means for movably mounting the body member to the first flanges of the right and left track members in the manner to allow the body member to be positioned at substantially any position between the first end and the second end of the tread member, with the body member arranged to accept counterforce from repairing and straightening the body and frame of the vehicle; and means for receiving at least upward and downward counterforces exerted on the body member and for subjecting the movably mounting means and the first flanges of the right and left track members only to the initial force under load condition, wherein the movably mounting means comprises, in combination: at least one shaft carried by the body member and having a first end which engages the first flange of the right track member and a second end which engages the first flange of the left track member.

21. The apparatus of claim 20 wherein the means for receiving the counterforce includes means for resiliently mounting the shaft in the body member such that, under a load condition, the shaft deflects due to the resiliently mounting means.

22. Apparatus for repairing and straightening the body and frame of a wheeled vehicle comprising, in combination: a tread member arranged for allowing support of the vehicle thereon, with the tread member having a first end and a second end and having a right track member and a left track member spaced from the right track member, with the right and left track members having a top surface and a bottom surface and having a first flange; a body member; at least one means for applying a force to the vehicle; means for interconnecting the force applying means to the body member; means for movably mounting the body member to the first flange of the right and left track members in the manner to allow the body member to be positioned at substantially any position between the first end and the second end of the tread member, with the body member arranged to accept counterforce from repairing and straightening the body and frame of the vehicle; and means for receiving at least upward and downward counterforces exerted on the body member and for subjecting the movably mounting means and the first flanges of the right and left track members only to the initial force under load condition, wherein the counterforce receiving means comprises, in combination: a top attached to the body member, with the top extending over the top surface of the right and left track members; and a bottom attached to the body member, with the bottom extending below the bottom surface of the right and left track members such that under load condition, the top contacts at least one of the top surfaces of the right and the left track members and the bottom contacts at least one of the bottom surfaces of the right and the left track members.

23. The apparatus of claim 27 wherein under no load condition, the top attached to the body member is vertically spaced above the top surfaces of the right and left track members and the bottom attached to the body member is vertically spaced below the bottom surfaces of the right and left track members such that only the movably mounting means contacts the right and left track members to reduce the sliding friction to a minimal amount.

24. Tram for use in an apparatus for repairing and straightening the body and frame of a wheeled vehicle comprising, in combination: a tram body; at least one means for applying a force to the vehicle; means for pivotally interconnecting the force applying means to the tram body; and means for movably mounting the tram body having the force applying means pivotally interconnected thereto to the apparatus for repairing and straightening, wherein the movably mounting means comprises, in combination: at least one shaft carried by the tram body having a first end and a second end and with the shaft engaging a portion of the apparatus for repairing and straightening; means for rotating the shaft; at least one stationary elongated gear member attached to the apparatus for repairing and straightening; and at least one sprocket carried by the shaft which meshes with the stationary, elongated member.

25. The tram of claim 24 wherein the apparatus for repairing and straightening includes a tread member having a top surface and a bottom surface and including a right track member and a left track member; and wherein the movably mounting means comprises: means for movably mounting the tram body between the right and left track members of the apparatus for repairing and straightening.

* * * * *